United States Patent [19]

Cordova

[11] 4,440,174

[45] Apr. 3, 1984

[54] WOMAN'S GARMENT

[75] Inventor: Robert A. Cordova, Laguna Hills, Calif.

[73] Assignee: Kayser-Roth Corporation, New York, N.Y.

[21] Appl. No.: 274,896

[22] Filed: Jun. 18, 1981

[51] Int. Cl.[3] ..... A41B 1/12; A41C 3/08

[52] U.S. Cl. ..... 128/455; 2/67

[58] Field of Search ..... 128/465, 490, 481, 479, 128/455, 488; 2/69, 67, 74, 106, 109, 78, 110; D2/211, 39, 24

[56] References Cited

U.S. PATENT DOCUMENTS

| | | | |
|---|---|---|---|
| D. 99,534 | 5/1936 | Stein | D2/211 |
| D. 105,845 | 8/1937 | Doctors | D2/211 |
| D. 105,846 | 8/1937 | Doctors | D2/211 |
| D. 105,847 | 8/1937 | Doctors | D2/211 |
| 183,016 | 10/1876 | Moeller | 2/78 R |
| D. 236,171 | 8/1975 | Froehlich | D2/211 |
| 338,024 | 3/1886 | Bilbrough | 2/113 |
| 1,382,742 | 6/1921 | Platt | 2/110 |
| 1,566,267 | 12/1925 | Bee | 128/455 |
| 1,834,846 | 12/1931 | Karnopp | 128/455 |
| 1,844,888 | 2/1932 | Lorenz | 128/455 |
| 2,250,094 | 7/1941 | Cornibert et al. | 15/250 |
| 2,341,596 | 2/1944 | Cobb | D2/39 |
| 2,458,696 | 1/1949 | Elias | 2/110 |
| 2,803,823 | 8/1957 | Broadwin | 128/435 |
| 3,020,914 | 2/1962 | Garson | 33/190 |
| 3,421,514 | 1/1969 | Friedlander | 128/454 |
| 3,913,146 | 10/1975 | Zero | 2/109 |
| 3,935,865 | 2/1976 | Newmar | 128/510 |

*Primary Examiner*—Doris L. Troutman

[57] ABSTRACT

A woman's tank top is provided including an outer shell adapted to be suspended from a wearer's shoulders by a plurality of shoulder straps. The tank top further includes an independently supported shelf bra having front and back portions secured about their top edges to the shell. An elastic band is further provided about the lower edges of the shelf bra in order to draw it about the wearer. The front portion of the shelf bra is shirred to define two pockets to permit the front portion of the bra to conform to the wearer's breasts.

10 Claims, 5 Drawing Figures

WOMAN'S GARMENT

BACKGROUND OF THE INVENTION

The present invention relates generally to a woman's garment and, more particularly, to a woman's tank top which incorporates therein a floating shelf bra to provide support for a woman's bust.

With the recent popularity of women's tank tops and T-shirts and, in particular, woman's tank tops which include spagetti or other thinly configured shoulder straps for supporting the garment, such straps are not of sufficient width to conceal the shoulder straps of a conventional bra. As a result, a woman wearing such a top is forced to either forego wearing a bra, to wear a strapless bra or to wear a conventional bra and permit the straps thereof to be seen. Vanity, taste and modesty being what they are, women were heretofore, confronted with a somewhat difficult choice.

This difficult choice led to the creation of the instant invention—i.e., a tank top which includes as a part thereof, a floating shelf bra which provides support for the wearer yeat eleminates any problem relative to the visibility of the shoulder straps. Moreover, this incorporation of a suspended shelf bra within such garment offers a "natural" look rather than a "fitted" look.

The incorporation of a bra or other type of foundation or support within a woman's garment has been attempted in the past. For example insertion of bosom gores were shown in U.S. Pat. No. 183,016 which issued to C. H. Moeller on Oct. 10, 1876 and U.S. Pat. No. 338,024, which issued to W. H. Bilbrough on Mar. 16, 1886. See also, for example, U.S. Pat. No. 2,250,094 which issued to C. A. Cornibert et al; U.S. Pat. No. 2,803,823 which issued to B. Broadwin on Aug. 27, 1957; U.S. Pat. No. 3,020,914 which issued to A. Garson on Feb. 13, 1962; U.S. Pat. No. 3,421,514 which issued to R. Friedlander on Jan. 1, 1969; U.S. Pat. No. Des. 99,534 which issued to S. Stein on May 5, 1936; U.S. Pat. No. Des. 105,845, U.S. Pat. No. Des. 105,846 and Des. 105,847, all of which issued to D. Doctors on Aug. 31, 1937; U.S. Pat. No. Des. 236,171 which issued to H. W. Froehlich on Aug. 5, 1975; U.S. Pat. No. Des. 236,242 which issued to H. W. Froehlich on Aug. 12, 1975; and U.S. Pat. No. Des. 232,602 which issued to I. Greenblatt et al on Sept. 3, 1974. All of these aforementioned patents disclose a molded or sewn in bra support in a woman's garment which cause or result in a tailored or fitted look to the garment. Current fashion design, particularly as it relates to woman garment tops, attempt to offer a softer more "natural" look.

Against the foregoing background, it is a primary object of the present invention to provide a woman's tank top garment which includes a sewn in foundation.

It is another object of the present invention to provide a woman's tank top garment which includes an independently supported shelf bra therein.

It is still another object of the present invention to provide a woman's tank top garment which includes an independently supported, shirred, shelf bra therein.

It is still yet another object of the present invention to provide a woman's tank top garment which includes a floating or otherwise independently supported, shirred shelf bra which will not chaff the wearer.

It is yet still another object of the present invention to provide a woman's tank top garment which provides support for a woman's bust yet still offers a natural appearance.

It is yet another object of the present invention to provide a woman's tank top garment which includes independent means for supporting the wearer's bust yet can be readily manufactured.

SUMMARY OF THE PRESENT INVENTION

To the accomplishments of the foregoing objects and advantages, the present invention, in brief summary comprises a woman's tank top garment including an outer shell adapted to be suspended from a wearer's shoulders by a plurality of shoulder straps. The tank top garment further includes an independently supported, shelf bra having front and back portions secured about their top edges to the shell. An elastic band is provided about the lower edge of the shelf bra in order to draw it about the wearer. The front portion of the shelf bra is shirred to define two pockets to permit the front portion of the bra to conform to the wearer's breasts.

BRIEF DESCRIPTION OF THE DRAWINGS

The foregoing and still other objects and advantages of the present invention will be made apparent from the following detailed explanation of the preferred embodiments of the invention in connection with the accompanying drawings, wherein.

DETAILED DESCRIPTION OF THE PREFERRED EMBODIMENTS

Figure 1:
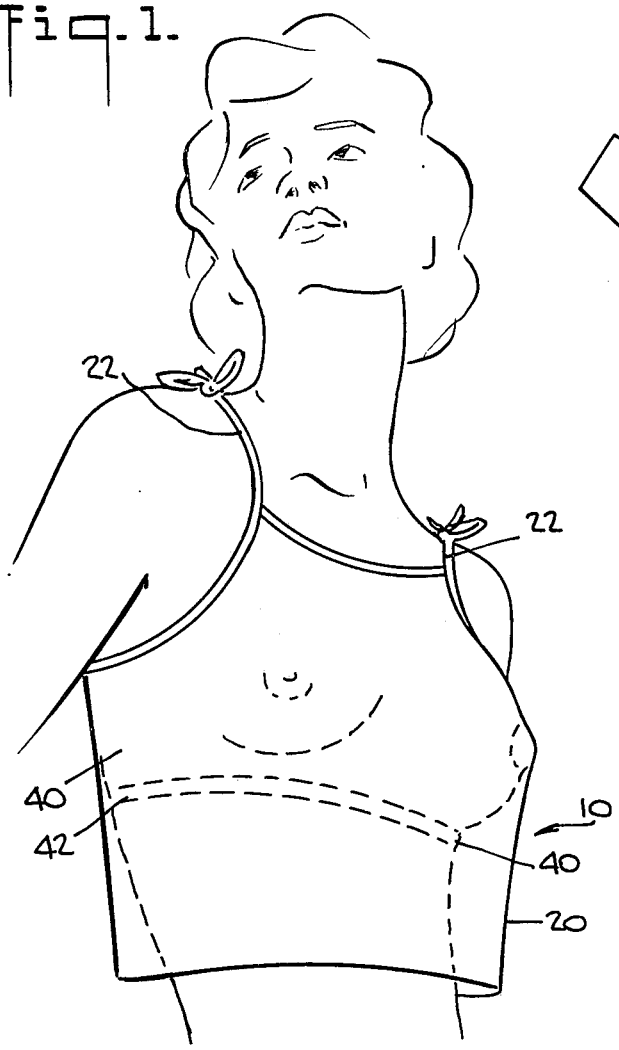
FIG. 1 is a perspective view illustrating the manner in which the tank top garment of the present invention may be worn.
Figure 5:
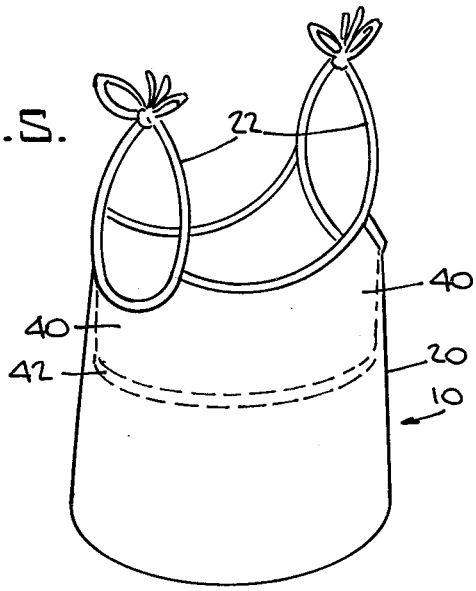
FIG. 5 is a perspective view illustrating the manner in which the shelf bra is affixed to the interior of the tank top garment.

Referring now to the drawings and, in particular, to FIG. 1 thereof, the woman's tank top garment of the present invention, referred to generally by reference numeral 10, is illustrated as it would be worn during use. Garment 10 includes a tank top or outer fabric shell 20 having an independently suspended, shelf bra 40 secured on the inside thereof. Tank top 20 may be of virtually any tank top or T-shirt configuration and includes shoulder straps 22 which provide support for the outer fabric shell 20. It will, of course, be appreciated that shoulder straps 22 may be of virtually any configuration. For example, as illustrated in FIGS. 1 and 5, the shoulder straps 22 may be tied spaghetti straps, and length of which may be readily adjusted by repositioning the knot. Shoulder straps 22 may also be of other configurations such as, for example, one piece, non-adjustable, spaghetti straps or even of a wider one piece shoulder strap.

Figure 2:
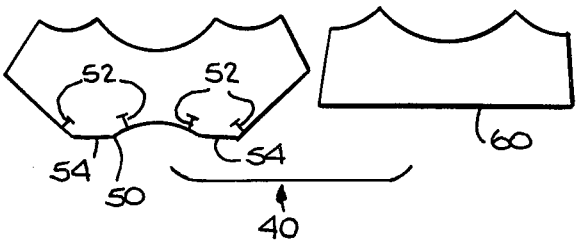
FIG. 2 is a front view illustrating the components of the shelf bra portion of the garment.
Figure 3:
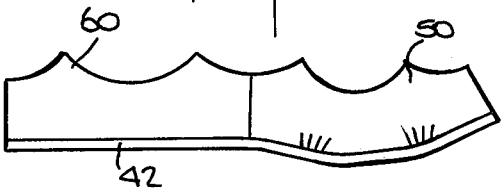
FIG. 3 is a front view illustrating the manner in which the two components of the shelf bra are attached.
Figure 4:
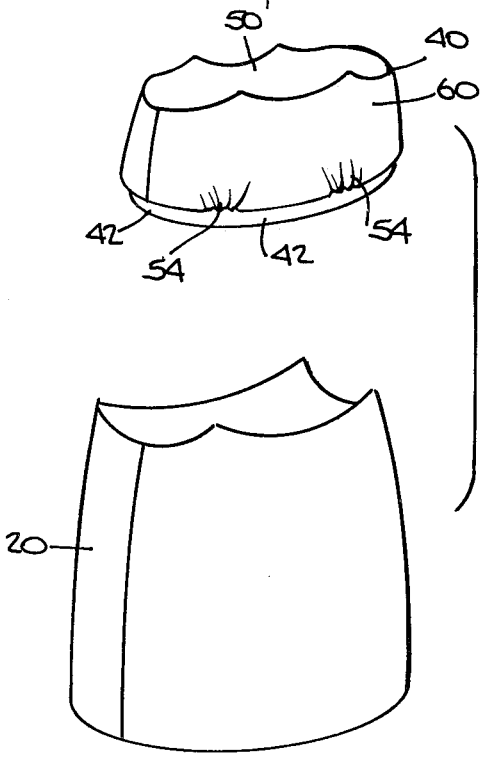
FIG. 4 is a breakaway perspective view illustrating the shelf bra in combination with a tank top.

A shelf bra 40, illustrated in FIGS. 2–4, is incorporated within tank top 20. Shelf bra 40 preferably includes front and back portions 50 and 60, respectively. While shelf bra 40 may be fabricated from virtually any material, it is preferred that it be made from tricot or nylon or any light weight, skin-compatable, fabric material. It may be desirable, in certain instances, to utilize a fabric which has a degree of stretch in at least one direction.

FIG. 2 illustrates the general patterns for front portion 50 and back portion 60 of the shelf bra 40 prior to attachment together and affixation within the tank top 20. It will, of course, be appreciated that the general configuration of the front and back portions 50 and 60, respectively, of the shelf bra 40 should generally conform to the size and configuration of the tank top 20. Front portion 50 is shirred between notches or seams 52 to create or otherwise form two pockets 54 therebetween to otherwise conform to and accommodate a woman's breasts when worn. The front portion 50 of the shelf bra 40 is preferably shirred in ratios of between about 3-1 and about 5-1. The shirring of the front portion 50 of the shelf bra 40 to form two pockets 54 create independant support for each breast.

As shown in FIG. 3, front and back portions 50 and 60 of shelf bra 40 are sewn or otherwise secured together at their ends to form a unitary, circumferential, one-piece shelf bra 40. An elastic band 42 is provided about the bottom edge of shelf bra 40. Elastic band 42, preferably between about ½" and about 1" in width, is padded with a felt or other soft material on its inner side to prevent chaffing to the wearer. Elastic band 42, preferably fabricated from a polyester or other like material, is of the recovery type in that, after full stretch, it will recover and contract to its original length. Elastic band 42 is designed to be fitted during wearing under a woman's breasts and, in combination with the shirring of the front portion 50 of the shelf bra 40, provides support therefore. The circumferential length of elastic band 42 in a non-expanded state and, correspondingly the circumfrence of the bottom edge of the shelf bra 40 in such state, is smaller than the circumfrence of the outer fabric tank top 20 at a corresponding point thus permitting independence of the shelf bra 40 from the tank top 20.

Shelf bra 40 is sewn or otherwise affixed along its top edge to the corresponding top edge of the tank top 20. Since the bottom edge of the bra 40 is not likewise affixed or sewn to the tank top 20, this permits independence or "floating" of the bra 40 relative to the tank top 20 as shown, for example, in FIGS. 1 and 5.

It will be readily appreciated that the woman's tank top garment 10 of the present invention offers numerous advantages over garments heretofore used. It eliminates the need for a woman to wear a separate bra in combination with a tank top. Moreover, it provides a lightweight, cool, non-cumbersome garment designed for active use while still providing a degree of support for a woman's bust. The shirring of the shelf bra 40, in combination with the bottom elastic band 42, provides independent support for a wearer's breasts while still maintaining a "natural" look. From a manufacturing standpoint, the garment 20 is easily assembled and requires no special sewing or knitting process.

Having thus described the invention with particular reference to the preferred forms thereof, it will be obvious that various changes and modifications may be made therein without departing from the spirit and scope of the invention as defined by the appended claims.

What is claimed is:

1. A woman's tank top outer garment having an outer shell with a top edge shaped to form a concave neckline, and a plurality of straps for suspending said outer shell from the shoulders of a wearer, said tank top outer garment including an independently suspended shelf bra formed separately from said outer shell for supporting a wearer's bust, said separate shelf bra having a bottom edge and an upper edge, said upper edge being shaped to conform to the concave neckline of said outer shell and affixed to said outer shell along said outer shell top edge only and including two shirred pockets for positioning over the bust of a wearer, said tank top further comprising an elastic band attached at said shelf bra bottom edge so that said shirred pockets and said elastic band act in combination to support the bust of a wearer independent of said tank top outer shell.

2. The tank top outer garment of claim 1 wherein said shelf bra includes front and back portions.

3. The tank top outer garment of claim 1 wherein said elastic band is adapted to draw said shelf bra about the wearer.

4. The tank top outer garment of claim 3 wherein said elastic band is padded on at least one side thereof.

5. The tank top outer garment of claim 2 wherein the front portion of said shelf bra includes a plurality of seams defining said two shirred pockets.

6. The tank top outer garment of claim 1 wherein said straps are spaghetti straps.

7. The tank top outer garment of claim 6 wherein said spaghetti straps are adjustable.

8. A woman's tank top outer garment having an outer shell formed with a concave neckline and adapted to be suspended from a wearer's shoulders by a plurality of shoulder straps, said tank top outer garment including an independently suspended shelf bra formed separately from said outer shell and having front and back portions being shaped to conform to the concave neckline of said outer shell, said separate shelf bra being secured about its top edge to the shell and including an elastic band having a padded portion secured about said shelf bra lower edge, said elastic band adapted to contact the wearer along said padded portion and to draw said shelf bra to said wearer, said front portion of said shelf bra being shirred to define two pockets to accomodate a wearer's breasts independent of said outer shell.

9. The tank top outer garment of claim 8 wherein said elastic band is padded on the side thereof adapted to be drawn against the wearer.

10. The tank top outer garment of claim 8 wherein said shoulder straps are adjustable spaghetti straps.

* * * * *